US011963566B1

(12) United States Patent
Sun

(10) Patent No.: US 11,963,566 B1
(45) Date of Patent: Apr. 23, 2024

(54) PREPARATION METHOD OF HAIR WEFT

(71) Applicant: Jiarong Sun, Rongcheng (CN)

(72) Inventor: Jiarong Sun, Rongcheng (CN)

( * ) Notice: Subject to any disclaimer, the term of this patent is extended or adjusted under 35 U.S.C. 154(b) by 0 days.

(21) Appl. No.: 18/506,107

(22) Filed: Nov. 9, 2023

(30) Foreign Application Priority Data

Oct. 26, 2023 (CN) ..... 202311405884.4

(51) Int. Cl.
*A41G 5/00* (2006.01)

(52) U.S. Cl.
CPC ..... *A41G 5/0046* (2013.01)

(58) Field of Classification Search
CPC ..... A41G 3/0075; A41G 5/004; A41G 5/0046
See application file for complete search history.

(56) References Cited

U.S. PATENT DOCUMENTS

2015/0257469 A1* 9/2015 Curbeon ..... A41G 5/0053 132/54
2016/0219958 A1* 8/2016 Wang ..... B65D 5/5035
2016/0295945 A1* 10/2016 Choi ..... A41G 5/0046
2020/0029640 A1* 1/2020 Adams ..... A45C 11/00

FOREIGN PATENT DOCUMENTS

CN 101489427 A * 7/2009 ..... A41G 3/0083
FR 2698246 A1 * 5/1994 ..... A41G 3/00
TW 200427418 A * 12/2004 ..... A41G 3/0083

* cited by examiner

*Primary Examiner* — Nicholas D Lucchesi

(57) ABSTRACT

The present disclosure provides a preparation method of a hair weft, including: batching hair strands according to a target weight to obtain a hair handle; forming a first quilting line and a second quilting line on a top of the hair handle with a double-needle sewing machine to obtain the hair weft; forming a third quilting line between the first quilting line and the second quilting line of the hair weft with a single-needle sewing machine; pasting a tape along the third quilting line to cause the tape to cover the hair weft; applying a glue between the first quilting line and the third quilting line, and drying the hair weft; cutting the hair weft along the first quilting line; soaking the hair weft in a softener; and putting the hair weft into a centrifuge for dehydration and shaking, and combing the hair strands.

9 Claims, 1 Drawing Sheet

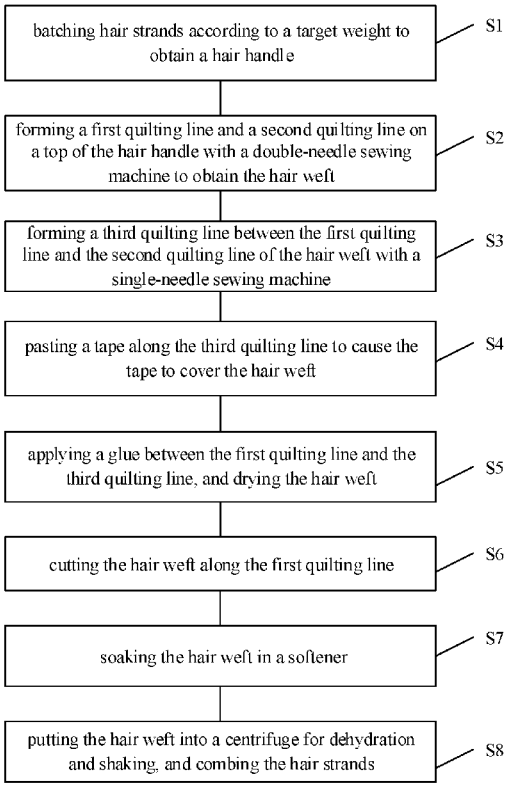

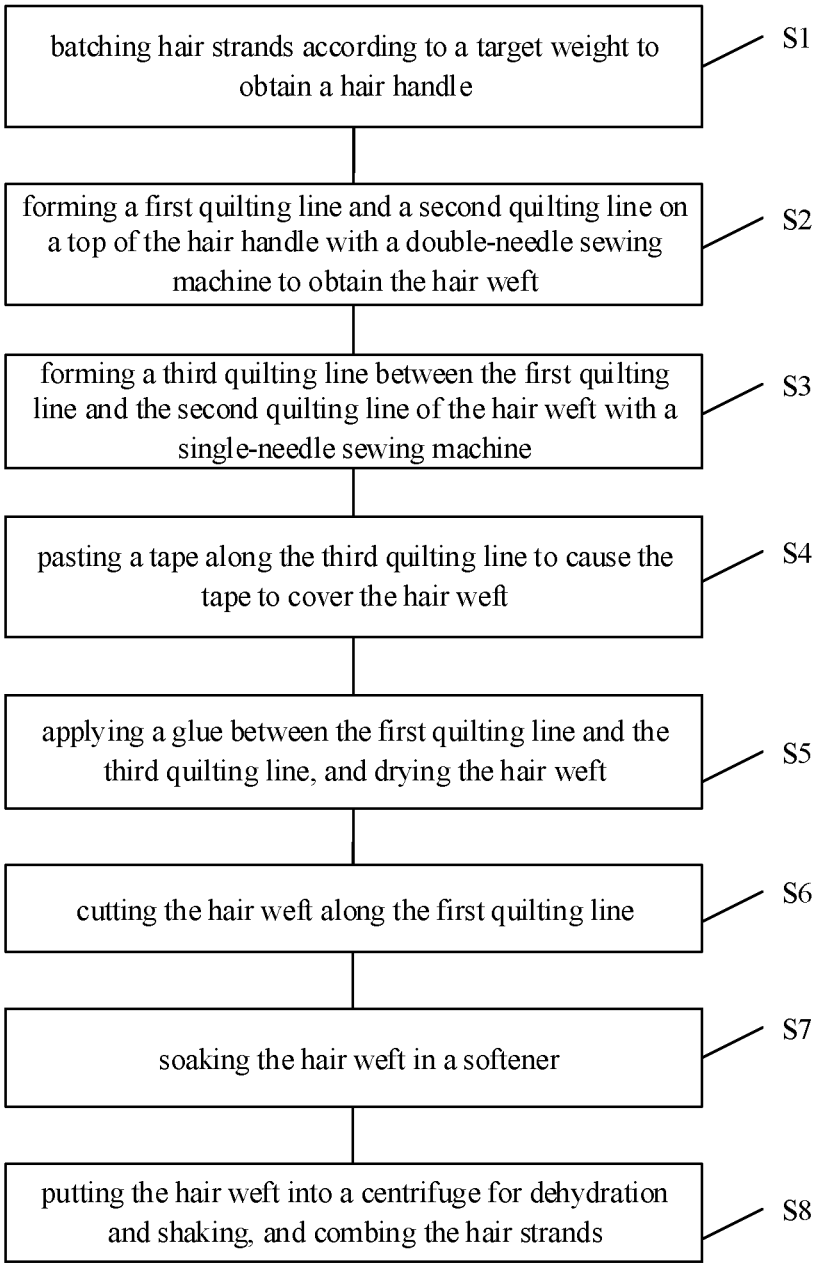
batching hair strands according to a target weight to obtain a hair handle
S1
forming a first quilting line and a second quilting line on a top of the hair handle with a double-needle sewing machine to obtain the hair weft
S2
forming a third quilting line between the first quilting line and the second quilting line of the hair weft with a single-needle sewing machine
S3
pasting a tape along the third quilting line to cause the tape to cover the hair weft
S4
applying a glue between the first quilting line and the third quilting line, and drying the hair weft
S5
cutting the hair weft along the first quilting line
S6
soaking the hair weft in a softener
S7
putting the hair weft into a centrifuge for dehydration and shaking, and combing the hair strands
S8

PREPARATION METHOD OF HAIR WEFT

CROSS REFERENCE

The present disclosure claims priority of Chinese Patent Application No. 202311405884.4, filed on Oct. 26, 2023, the entire contents of which are hereby incorporated by reference in their entirety.

TECHNICAL FIELD

The present disclosure relates to technical field of wig manufacturing, especially relates to a preparation method of a hair weft.

BACKGROUND

With the development of the economy, more and more people begin to wear hair extensions. Wearing hair extensions has the effect of appearance modification, and has advantages of simple and convenient changing hairstyles, saving time, and avoiding hair damage caused by hair perming, dyeing, and pulling. Also, the cost of doing hairstyles in the barbershop, bleaching and dyeing hair piece can be saved, which reduces expenses. Further, hairstyles can be changed at will to avoid frequent trips to the barbershop for hair styling causing damage to the hair quality. People can try a variety of hair extensions with different designs, with different fashion, which causes wearing hair extensions to become increasingly popular.

As the most traditional and oldest product type in the hair extension industry, a hair weft dominates the mainstream market with its wide head coverage and large hair volume.

However, the common hair weft products are mostly handmade or produced by a triple-head weft machine. The handmade hair weft has a long production time and low production capacity. The machine-made hair weft, after a weft edge is folded twice by the triple-head weft machine, has an obvious folding edge and thicker weft edge, such that the wearing experience is poor. In addition, the two kinds of hair wefts have folded hair, increasing the production loss; further, the back-folded short hair will be in contact with the scalp when the wearer moves, resulting in a tingling sensation.

SUMMARY OF THE DISCLOSURE

Based on this, it is necessary to propose a preparation method of a hair weft, which has a high production efficiency and has no short hair folding back.

The present disclosure provides a preparation method of a hair weft, including:

S1: batching hair strands according to a target weight to obtain a hair handle;

S2: forming a first quilting line and a second quilting line on a top of the hair handle with a double-needle sewing machine to obtain the hair weft;

S3: forming a third quilting line between the first quilting line and the second quilting line of the hair weft with a single-needle sewing machine;

S4: pasting a tape along the third quilting line to cause the tape to cover the hair weft;

S5: applying a glue between the first quilting line and the third quilting line, and drying the hair weft;

S6: cutting the hair weft along the first quilting line;

S7: soaking the hair weft in a softener; and

S8: putting the hair weft into a centrifuge for dehydration and shaking, and combing the hair strands.

In some embodiments, in S2, the first quilting line is a cotton sewing thread and the second quilting line is a water-soluble sewing thread.

In some embodiments, the double-needle sewing machine has a gauge of 30-35 stitches per inch, and a spacing between the first quilting line and the second quilting line is 3-4 mm.

In some embodiments, in S3, the third quilting line is a cotton sewing thread, and a spacing between the third quilting line and the first quilting line is 1 mm.

In some embodiments, S5 includes:

S51: applying a first glue between the first quilting line and the third quilting line on a front side of the hair weft, and drying the hair weft at a drying temperature of 45-50° C. for 15 minutes;

S52: applying a second glue between the first quilting line and the third quilting line on the front side of the hair weft, and drying the hair weft at a drying temperature of 45-50° C. for 15 minutes;

S53: applying a third glue between the first quilting line and the third quilting line on the front side of the hair weft, and drying the hair weft at a drying temperature of 45-50° C. for 120 minutes;

S54: applying a fourth glue between the first quilting line and the third quilting line on a back side of the hair weft, and drying the hair weft at a drying temperature of 45-50° C. for 15 minutes;

S55: applying a fifth glue between the first quilting line and the third quilting line on the back side of the hair weft, and drying the hair weft at a drying temperature of 45-50° C. for 15 minutes; and

S56: applying a sixth glue between the first quilting line and the third quilting line on the back side of the hair weft, and drying the hair weft at a drying temperature of 45-50° C. for 240 minutes.

In some embodiments, S7 includes:

S71: adding 2 g-3 g of a sodium hypochlorite solution to 1 kg of water at 40° C. to obtain a first solution, and soaking the hair weft in the first solution for 5 minutes;

S72: washing the hair weft with water at 40° C.;

S73: adding 30 g of the softener to 1 kg of water at 50° C. to obtain a second solution, and soaking the hair weft in the second solution for 10 minutes; and

S74: adding 40 g of the softener to 1 kg of water at 50° C. to obtain a third solution, and soaking the hair weft in the third solution for 10 minutes.

In some embodiments, S8 includes: placing the hair weft into the third solution to be slightly moistened, unfolding and laying flat the hair weft, scraping out water, and drying the hair weft.

In some embodiments, S1 includes: dyeing the hair strands before the batching.

In some embodiments, the preparation method further includes: S9: ironing and combing the hair weft, stacking the hair weft, and bundling and packaging for transportation.

The present disclosure provides a preparation method of a hair weft, including: batching hair strands according to a target weight to obtain a hair handle; forming a first quilting line and a second quilting line on a top of the hair handle with a double-needle sewing machine to obtain the hair weft; forming a third quilting line between the first quilting line and the second quilting line of the hair weft with a single-needle sewing machine; pasting a tape along the third quilting line to cause the tape to cover the hair weft; applying a glue between the first quilting line and the third quilting line, and drying the hair weft; cutting the hair weft along the first quilting line; soaking the hair weft in a softener; and putting the hair weft into a centrifuge for dehydration and shaking, and combing the hair strands. The hair weft prepared by the method of the present disclosure has a high production efficiency and has no short hair folding back, which is less lossy and less prone to hair loss compared to handmade hair wefts, and does not have the problems of wearing discomfort and poor breathability caused by too thick and too hard weft edge compared to the hair wefts made by a triple-head weft machine, and does not irritate the skin.

BRIEF DESCRIPTION OF THE DRAWINGS

In order to more clearly illustrate the technical solutions in the specific embodiments or related art of the present disclosure, the accompanying drawings to be used in the description of the specific embodiments or related art will be briefly introduced below. It will be obvious that the accompanying drawings in the following description are some of the embodiments of the present disclosure, and that for those skilled in the art, other attachments can be obtained based on these accompanying drawings without putting in creative labor.

Solo FIGURE is a flowchart of a preparation method of a hair weft according to an embodiment of the present disclosure.

DETAILED DESCRIPTION

The following will be a clear and complete description of the technical solutions in the embodiments of the present disclosure in conjunction with the accompanying drawings in the embodiments of the present disclosure. Obviously, the described embodiments are only a part of the embodiments of the present disclosure, and not all of them. Based on the embodiments in the present disclosure, all other embodiments obtained by those skilled in the art without creative labor fall within the scope of the present disclosure.

In the description of the present disclosure, it is noted that when the terms "center", "up", "down", "left", "right", "vertical", "horizontal", "inner", "outer", etc. appear, they are indicative of an orientation or positional relationship based on that shown in the accompanying drawings, which is intended only to facilitate and simplify the description of the present disclosure and is not indicative of, or suggestive of, the necessity for the device or element referred to to be of a particular orientation, or to be constructed and operated in a particular orientation, and therefore is not to be construed as a limitation of the present disclosure. Furthermore, the terms "first", "second", "third", if present, are used for descriptive purposes only and are not to be understood as indicating or implying relative importance.

As shown in FIG. 1, a preparation method of a hair weft provided by the present disclosure includes the following steps, which are illustrated at blocks.

At block S1: batching hair strands according to a target weight to obtain a hair handle. In some embodiments, a 100 g weight of hair strands is taken as an example for making the hair handle.

At block S2: forming a first quilting line and a second quilting line on a top of the hair handle with a double-needle sewing machine to obtain the hair weft. Specifically, the first quilting line is a cotton sewing thread and the second quilting line is a water-soluble sewing thread. The double-needle sewing machine has a gauge of 30-35 stitches per inch, and a spacing between the first quilting line and the second quilting line is 3-4 mm. In this way, the hair weft may be secured for subsequent production.

At block S3: forming a third quilting line between the first quilting line and the second quilting line of the hair weft with a single-needle sewing machine. Specifically, the third quilting line is a cotton sewing thread, and a spacing between the third quilting line and the first quilting line is 1 mm. Since there are two cotton sewing threads, namely, the first quilting line and the third quilting line, and the spacing therebetween is only 1 millimeter, the hair weft may not have problems such as discomfort of wearing and poor breathability caused by the weft edge being too thick and too hard.

At block S4: pasting a tape along the third quilting line to cause the tape to cover the hair weft. Specifically, a textured paper tape is pasted along the third quilting line made of cotton, such that the textured paper tape covers the hair strands, thereby preventing a glue from penetrating into the interior of the hair strands during the step of applying the glue, and shaping the hair weft.

At block S5: applying a glue between the first quilting line and the third quilting line, and drying the hair weft.

At block S6: cutting the hair weft along the first quilting line. Specifically, the protruding excess hair strands are cut off along the first quilting line made of cotton, retaining only 1 mm of hair strands above the third quilting line, which can make the weft edge of the hair weft invisible when wearing the hair weft, and the hair weft is stable while not being affected by the sewing threads.

At block S7: removing the textured paper tape and soaking the hair weft in a softener. Since the second quilting line is a water-soluble sewing thread, the second quilting line will dissolve and disappear when the hair weft is soaked.

At block S8: putting the hair weft into a centrifuge for dehydration and shaking, and combing the hair strands.

In step S5, the glue may be a mixture of a polycarbonate glue, an adhesive, and a diluent. In some embodiments, step S5 includes the following steps:

- Step S51: applying a first glue between the first quilting line and the third quilting line on a front side of the hair weft, and drying the hair weft at a drying temperature of 45-50° C. for 15 minutes;
- Step S52: applying a second glue between the first quilting line and the third quilting line on the front side of the hair weft, and drying the hair weft at a drying temperature of 45-50° C. for 15 minutes;
- Step S53: applying a third glue between the first quilting line and the third quilting line on the front side of the hair weft, and drying the hair weft at a drying temperature of 45-50° C. for 120 minutes;
- Step S54: applying a fourth glue between the first quilting line and the third quilting line on a back side of the hair weft, and drying the hair weft at a drying temperature of 45-50° C. for 15 minutes;
- Step S55: applying a fifth glue between the first quilting line and the third quilting line at the back side of the hair weft, and drying the hair weft at a drying temperature of 45-50° C. for 15 minutes;
- Step S56: applying a sixth glue between the first quilting line and the third quilting line on the back side of the hair weft, and drying the hair weft at a drying temperature of 45-50° C. for 240 minutes.

The glue is repeatedly scraped using a scraper each time the glue is applied, such that the glue is in uniform contact with the hair strands and serves to fix the hair strands.

In some embodiments, step S7 includes the following steps:

Step S71: adding 2 g-3 g of a sodium hypochlorite solution to 1 kg of water at 40° C. to obtain a first solution, and soaking the hair weft in the first solution for 5 minutes;

Step S72: washing the hair weft with water at 40° C.;

Step S73: adding 30 g of the softener to 1 kg of water at 50° C. to obtain a second solution, and soaking the hair weft in the second solution for 10 minutes;

Step S74: adding 40 g of the softener to 1 kg of water at 50° C. to obtain a third solution, and soaking the hair weft in the third solution for 10 minutes.

In some embodiments, step S8 further includes placing the hair weft into the third solution slightly moistened, unfolding and laying flat the hair weft, scraping out the water, and drying. Specifically, the dried hair weft is combed using a dense-toothed comb, floating hairs on the hair weft are scraped off, the hair weft is put into the third solution again to be slightly moistened and then unfolded and laid flat on an iron plate, the excess water is scraped off using a brush, and the hair weft is put into a drying room at 50° C. for drying.

It is to be understood that the hair extension may have a variety of different colors. Therefore, step S1 may further include dyeing the hair strands before batching, and obtaining a dyed hair handle after batching, thereby preparing a dyed hair weft.

Further, the preparation method may further include step S9: ironing and combing the hair weft, stacking the hair weft, and bundling and packaging for transportation.

The present disclosure provides a preparation method of a hair weft, including: batching hair strands according to a target weight to obtain a hair handle; forming a first quilting line and a second quilting line on a top of the hair handle with a double-needle sewing machine to obtain the hair weft; forming a third quilting line between the first quilting line and the second quilting line of the hair weft with a single-needle sewing machine; pasting a tape along the third quilting line to cause the tape to cover the hair weft; applying a glue between the first quilting line and the third quilting line, and drying the hair weft; cutting the hair weft along the first quilting line; soaking the hair weft in a softener; and putting the hair weft into a centrifuge for dehydration and shaking, and combing the hair strands. The hair weft prepared by the method of the present disclosure has a high production efficiency and has no short hair folding back, which is less lossy and less prone to hair loss compared to handmade hair wefts, and does not have the problems of wearing discomfort and poor breathability caused by too thick and too hard weft edge compared to the hair wefts made by a triple-head weft machine, and does not irritate the skin.

The above embodiments are only intended to illustrate the technical solution of the present disclosure, not to limit it; although the present disclosure has been described in detail with reference to the foregoing embodiments, those skilled in the art should understand that it is still possible to modify the technical solution recorded in the foregoing embodiments, or to replace some or all of the technical features with equivalent ones; and these modifications or replacements do not make the corresponding technical solution deviate from the essence of the technical solution of the present disclosure.

What is claimed is:

1. A preparation method of a hair weft, comprising:

S1: batching hair strands according to a target weight to obtain a hair handle;

S2: forming a first quilting line and a second quilting line on a top of the hair handle with a double-needle sewing machine to obtain the hair weft;

S3: forming a third quilting line between the first quilting line and the second quilting line of the hair weft with a single-needle sewing machine;

S4: pasting a tape along the third quilting line to cause the tape to cover the hair weft;

S5: applying a glue between the first quilting line and the third quilting line, and drying the hair weft;

S6: cutting the hair weft along the first quilting line;

S7: soaking the hair weft in a softener; and

S8: putting the hair weft into a centrifuge for dehydration and shaking, and combing the hair strands.

2. The preparation method according to claim 1, wherein in S2, the first quilting line is a cotton sewing thread and the second quilting line is a water-soluble sewing thread.

3. The preparation method according to claim 2, wherein the double-needle sewing machine has a gauge of 30-35 stitches per inch, and a spacing between the first quilting line and the second quilting line is 3-4 mm.

4. The preparation method according to claim 3, wherein in S3, the third quilting line is a cotton sewing thread, and a spacing between the third quilting line and the first quilting line is 1 mm.

5. The preparation method according to claim 1, wherein S5 comprises:

S51: applying a first glue between the first quilting line and the third quilting line on a front side of the hair weft, and drying the hair weft at a drying temperature of 45-50° C. for 15 minutes;

S52: applying a second glue between the first quilting line and the third quilting line on the front side of the hair weft, and drying the hair weft at a drying temperature of 45-50° C. for 15 minutes;

S53: applying a third glue between the first quilting line and the third quilting line on the front side of the hair weft, and drying the hair weft at a drying temperature of 45-50° C. for 120 minutes;

S54: applying a fourth glue between the first quilting line and the third quilting line on a back side of the hair weft, and drying the hair weft at a drying temperature of 45-50° C. for 15 minutes;

S55: applying a fifth glue between the first quilting line and the third quilting line on the back side of the hair weft, and drying the hair weft at a drying temperature of 45-50° C. for 15 minutes; and S56: applying a sixth glue between the first quilting line and the third quilting line on the back side of the hair weft, and drying the hair weft at a drying temperature of 45-50° C. for 240 minutes.

6. The preparation method according to claim 1, wherein S7 comprises:

S71: adding 2 g-3 g of a sodium hypochlorite solution to 1 kg of water at 40° C. to obtain a first solution, and soaking the hair weft in the first solution for 5 minutes;

S72: washing the hair weft with water at 40° C.;

S73: adding 30 g of the softener to 1 kg of water at 50° C. to obtain a second solution, and soaking the hair weft in the second solution for 10 minutes; and S74: adding 40 g of the softener to 1 kg of water at 50° C. to obtain a third solution, and soaking the hair weft in the third solution for 10 minutes.

7. The preparation method according to claim 6, wherein S8 comprises: placing the hair weft into the third solution to be slightly moistened, unfolding and laying flat the hair weft, scraping out water, and drying the hair weft.

8. The preparation method according to claim 1, wherein S1 comprises: dyeing the hair strands before the batching.

9. The preparation method according to claim 1, further comprising:

S9: ironing and combing the hair weft, stacking the hair weft, and bundling and packaging for transportation.

* * * * *